US005878541A

United States Patent [19]

Gruber

[11] Patent Number: 5,878,541

[45] Date of Patent: Mar. 9, 1999

[54] CEILING CONSTRUCTION AND CEILING PANEL

[76] Inventor: Eva Gruber, R. Riemannstr. 9, 5700 Zall am See, Austria

[21] Appl. No.: 867,460

[22] Filed: Jun. 2, 1997

[30] Foreign Application Priority Data

Jun. 3, 1996 [DE] Germany ..... 296 09 800 U

[51] Int. Cl.[6] ..... E04B 5/40; E04B 9/04

[52] U.S. Cl. ..... 52/454; 52/801.1; 249/18; 249/189; 249/192; 249/210

[58] Field of Search ..... 52/454, 801.1, 52/18; 249/18, 189, 210, 192

[56] References Cited

U.S. PATENT DOCUMENTS

| | | | |
|---|---|---|---|
| 1,972,638 | 9/1934 | Bailey | 52/454 |
| 2,903,880 | 9/1959 | Johnson | 52/454 |
| 3,010,258 | 11/1961 | Hunter | 52/454 |
| 4,802,321 | 2/1989 | Menchetti | 52/801.1 X |

FOREIGN PATENT DOCUMENTS

| | | |
|---|---|---|
| 0 164 330 | 12/1985 | European Pat. Off. . |
| 0258205B1 | 3/1988 | European Pat. Off. . |
| 34 10 484 | 10/1985 | Germany . |
| 4327115A1 | 2/1995 | Germany . |
| 43 36 242 | 5/1995 | Germany . |
| 43 41 856 | 10/1995 | Germany . |

OTHER PUBLICATIONS

European Search Report of Sep. 19, 1997.

*Primary Examiner*—Christopher Kent

*Attorney, Agent, or Firm*—Finnegan, Henderson, Farabow, Garrett & Dunner, L.L.P.

[57] ABSTRACT

A ceiling construction, especially for a large area shuttering construction for reinforced concrete ceilings, has a plurality of ceiling panels laterally abutting to each other. On a main plate of the ceiling panel, U-profiled shackles are arranged in a row and are aligned with each other. The U-profiled shackles have a web, two legs extending from the web to the main plate and having free ends, and flanges formed extending outwardly at a right angle from the free ends and being screwed to the main plate. Isolated longitudinal bars are fixed by a welding connection in the corners formed by the webs and legs of the U-profiled shackle. The isolated longitudinal bars are located away from the main plate. The ceiling construction is covered with concrete. During the construction and concrete operation, the isolated longitudinal bars serve to transmit forces of pressure. In the completed, solidified state, the bars serve to transmit tensile forces.

6 Claims, 2 Drawing Sheets

CEILING CONSTRUCTION AND CEILING PANEL

BACKGROUND OF THE INVENTION

The invention relates to a ceiling construction, especially to a large area shuttering construction for reinforced concrete ceilings, having a plurality of ceiling panels, and a ceiling panel for the ceiling construction.

EP-0 164 330 discloses compound shuttering ceilings having load bearing braced steel girders and shuttering panels fixed to the braced steel girders by fixing elements. The shuttering panels also form a ceiling surface. In this embodiment, the top chord of the braced steel girder bears the forces of pressure during the mounting operation, the concreting operation, and the solidification of the concrete. After the solidification of the concrete, the armoring construction of the ceiling having the top cord and oblique bars forming stabilizing connections of the braced steel girder become statically useless.

Conventional compound systems further have the disadvantage of having large spatial requirements. Thus, large transportation capacities and high transportation costs are necessary to transport the compound system in the form of premanufactured components of a construction kit. Further, the construction of the components of conventional compound systems is complicated and, therefore, it requires complicated manufacturing processes and high manufacturing costs.

SUMMARY OF THE INVENTION

The invention solves the problem by providing a compound shuttering ceiling, which forms the finished ceiling, and ceiling panels for the compound shuttering ceiling. The ceiling panels have armoring construction of steel. The armoring construction of steel takes bearing functions during the manufacturing operation of the ceiling and after the manufacturing of the ceiling. Therefore, the armoring construction can be taken into account for the statics of the ceiling, and at the same time, the compound shuttering ceiling can be manufactured at low costs.

According to the invention, the object with respect to the compound shuttering ceiling is achieved by a ceiling construction comprising a plurality of ceiling panels. Each of the ceiling panels comprises a main plate having lateral abutment edges flushly abutting against abutment edges of another main plate, U-profiled shackles arranged in a row on the main plate and aligned with each other. Each of the U-profile shackles has a web, two legs having free ends and extending from the web to the main plate defining corners, and flanges formed at the free ends. The flanges extend at a right angle from the free ends outwardly with respect to each of the U-profiled shackles and are screwed to the main plate. Isolated longitudinal bars are fixed by welding connection means at the corners and arranged away from the main plate. The isolated longitudinal bars serve to transmit forces of pressure and the main plate serves to transmit tensile forces when the main plate is not covered with concrete or is covered with a unsolidified concrete layer. The isolated longitudinal bars serve to transmit tensile forces when the main plate is covered with a solidified concrete layer, and the isolated longitudinal bars are embedded in an appropriate quantity of the solidified concrete layer.

The U-profiled shackles are mounted to the main plate such that the web of the U-profiled shackle is arranged with a distance away from the main plate and the legs of the U-profiled shackle extend from the web towards the main plate. Flanges are provided at the free ends of the legs ending at the main plate, extend in a right angle with respect to the legs outwardly, and are screwed to the main plate.

When mounted in a ceiling panel, isolated longitudinal bars are away from the main plate, such that they serve to receive forces of pressure during the mounting operation and the complete solidification of the concrete, and serve to receive tensile forces after the solidification of the concrete. Thus, a multiple functionality of the ceiling construction is achieved. The ceiling construction can, at the same time, serve as shuttering construction and statically bearing armoring construction of the completed concrete ceiling.

The isolated longitudinal bars are arranged in a sufficient distance away from the main plate, so that they receive the weight forces of the ceiling construction and the forces occurring during the concrete casting operation as a consequence of the weight of the concrete as bars receiving forces of pressure. In this load bearing ceiling construction, the main plate itself serves as a component receiving the tensile forces. The transmission of the shear forces between the bars receiving the forces of pressure and the component receiving the tensile forces in this supporting construction is achieved by means of the shear force transmitting welding connections and screwing connections, respectively.

The shuttering ceiling panels of the ceiling construction are dimensioned such that they are adapted to the thickness of the concrete ceiling to be manufactured, and the isolated longitudinal bars are arranged in the lower part of the completed concrete ceiling, especially in the lower third of the completed concrete ceiling. Thus, the isolated longitudinal bars serve to receive the tensile forces of the reinforced concrete ceiling in the completed state of the concrete ceiling. In the solidified state, the concrete receives the corresponding forces of pressure.

When the ceiling panels flushly abut each other at the abutment edges, the abutment edges can be covered by a cover ledge or a collar strip and/or be screwed to each other by means of brackets.

By providing this simple construction of an armoring construction of the main plate having simple U-profiled shackles which can be manufactured of folded sheet material, and welding and screwing connections, respectively, simplification and cost reduction of construction are achieved.

According to the invention, the fixing of the isolated longitudinal bars to the U-profiled shackles can be realized by means of a welding connection extending over the complete length of the U-profiled shackle. However, preferably, the fixing of the isolated longitudinal bars to the U-profiled shackles can be realized by means of a single spot weld at each connection between a isolated longitudinal bar and a U-profiled shackle. Furthermore, the fixing of the isolated longitudinal bars to the U-profiled shackles can be realized preferably by means of a welding spot at each end of the U-profiled shackle.

According to the invention the U-profiled shackles can have any dimensions appropriate to realize the desired relative position between the isolated longitudinal bars and the main plate. Also, according to the invention, it is possible to use short U-profiled shackles having a width of the web of the U-profiled shackle which is much wider than the length of the U-profiled shackle. Preferably, the width of the web of which is significantly shorter than the length of the U-profiled shackle.

An appropriate welding connection of a U-profiled shackle having a length shorter than a web width can support particularly high bending load of the compound ceiling construction.

The main plates of the ceiling panels of the ceiling constructions according to the invention can be manufactured with any appropriate material. But, preferably, the main plate are made of cement plates. Such cement plates can be manufactured easily at low cost and can readily be connected by screwing with the armoring construction. Moreover, such cement plates can be easily reinforced by integrated armoring construction of steel. Thus, particular loads can be supported without changing the dimensions.

A cement plate can be manufactured of various materials. Preferably, a cement plate comprising wood cement is used. Because wood is suitable for a room climate, especially for controlled humidity.

The objects of this invention are achieved by a ceiling construction, comprising: a plurality of ceiling panels, each of the ceiling panels comprising a main plate having lateral abutment edges flushly abutting against abutment edges of another main plate, U-profiled shackles arranged in a row on the main plate and aligned to each other, each of the U-profile shackles having a web, two legs having free ends and extending from the web to the main plate defining corners, and flanges formed at the free ends, the flanges extending at a right angle from the free ends outwardly with respect to each of the U-profiled shackles and being screwed to the main plate; and isolated longitudinal bars fixed by welding connection means at the corners and arranged away from the main plate, the isolated longitudinal bars serving to transmit forces of pressure and the main plate serving to transmit tensile forces when the main plate is not covered with concrete or is covered with a unsolidified concrete layer, the isolated longitudinal bars serving to transmit tensile forces when the main plate is covered with a solidified concrete layer and the isolated longitudinal bars are embedded in an appropriate quantity of the solidified concrete layer.

BRIEF DESCRIPTION OF THE DRAWINGS

The accompanying drawings, which are incorporated in and constitute a part of this specification, illustrate embodiments of the invention and together with the description, serve to explain the principles of the invention. In the drawings.

DESCRIPTION OF THE PREFERRED EMBODIMENTS

Figure 1:
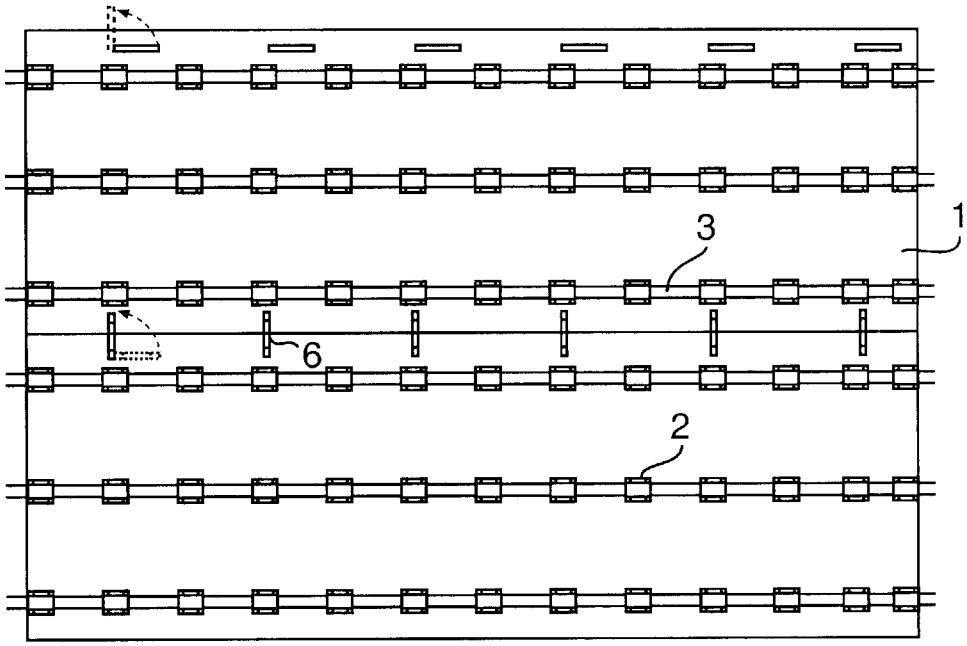
FIG. 1 is a plan view of a ceiling construction having two ceiling panels according to the invention, from the side of the ceiling panels to which the armoring construction is mounted.

FIG. 1 shows a ceiling construction according to the invention in a plane view. The ceiling construction has two ceiling panels arranged side by side. Main plates 1 are rectangular. Aligned rows of U-profiled shackles 2 are mounted to each main plate. The rows are extending in parallel to each other and in the longitudinal direction of the main plate 1. Isolated longitudinal bars 3 are mounted to each row of the U-profiled shackles 2. The isolated longitudinal bars are extending over the two transverse edges la of the main plates 1. Extending ends 3*a* of the isolated longitudinal bars 3 are fixed to walls 7 supporting the ceiling (see FIG. 4), so that the isolated longitudinal bars 3 have a bearing function. When the reinforced concrete ceiling is completed. The main plates 1 of the two ceiling panels arranged side by side are connected to each other by means of connection elements 6.

Figure 2:
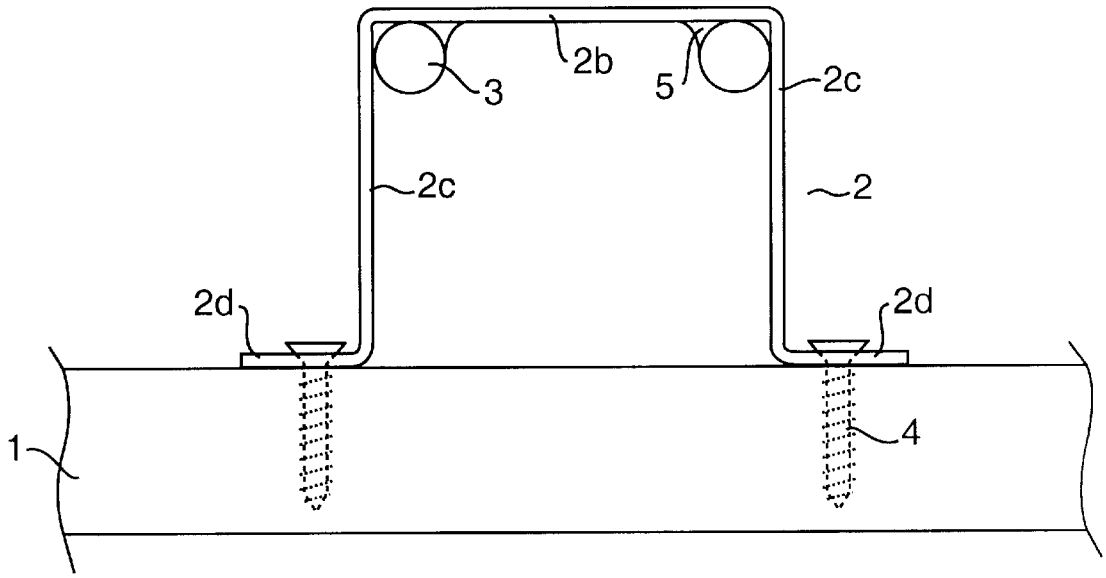
FIG. 2 is a cross sectional view of a U-profiled shackle fixed at the main plate and isolated longitudinal bars.

As can be seen from FIG. 2, the U-profiled shackle 2 comprises a web 2*b*, two legs 2*c* extending from the web 2*b* to the main plate 1 and having free ends. Corners are formed where the legs 2*c* are extending from the web 2*b*. Flanges 2*d* are formed at the free ends of the legs 2*c*, and are extending at a right angle from the free ends outwardly with respect to the U-profiled shackle 2 and being screwed to the main plate 1.

Figure 3:
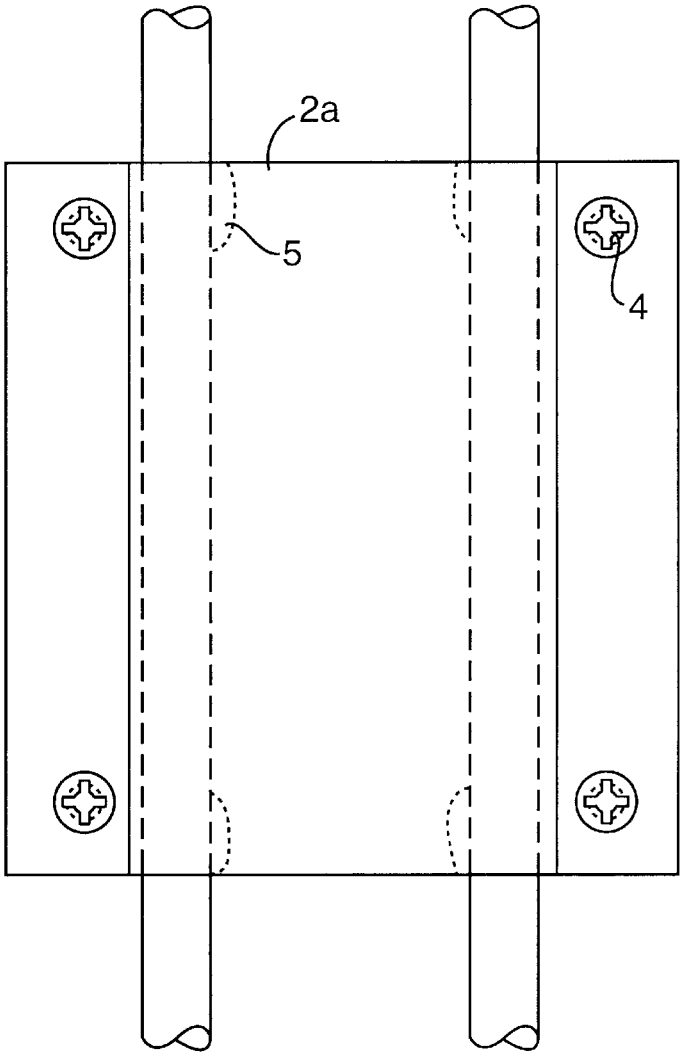
FIG. 3 is an enlarged plan view of a U-profiled shackle of the armoring construction together with sections of the isolated longitudinal bars fixed to the isolated longitudinal bars.

From FIG. 3, it can be seen that four screws 4 are provided to fix a U-profiled shackle 2 to the main plate 1. Each of the isolated longitudinal bars 3 is fixed by two welding spots 5 at the longitudinal ends 2*a* of the U-profiled shackle 2. Each of the U-profiled shackles 2 has a significantly larger length than the width of the web 2*b* of the U-profiled shackle 2. They have a length approximately twice as long as the width of the webs. FIG. 2 illustrates each of the isolated longitudinal bars 3 having a circular cross section. The bar is arranged at the corner formed by the web 2*b* and one of the legs 2*c* of the U-profiled shackle 2 and is fixed to the U-profiled shackle 2 by welding spots 5 at the side of the web 2*b*. The U-profiled shackle 2 is fixed to the main plate 1 by screws 4. The screws 4 do not completely penetrate through the main plate 1.

Figure 4:
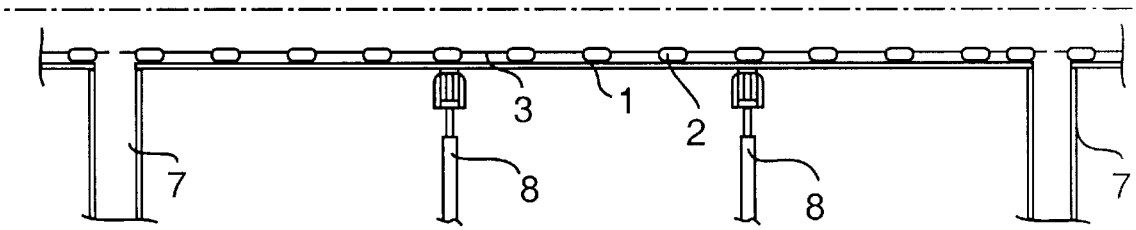
FIG. 4 is a side view of a ceiling panel arranged for the covering with concrete and a ceiling construction covered with concrete, respectively.

As can be seen from FIG. 4, the ceiling panels are connected to the supporting walls 7 before the concrete operation. The ceiling panels are supported from below in the central section by supporting elements 8. The concrete layer subsequently cast on the ceiling panel is shown by a dot-and-dash line. The concrete layer has a thickness such that the armoring construction having the U-profiled shackles 2 and the isolated longitudinal bars 3 is arranged in the lower third of the concrete layer.

I claim:

1. A ceiling construction comprising:

a plurality of ceiling panels, each of said ceiling panels comprising a main plate having lateral abutment edges flushly abutting against abutment edges of another main plate; and U-profiled shackles arranged in a row on said main plate and aligned with each other, each of said U-profile shackles having a web, two legs having free ends and extending from the web to the main plate and defining corners, and flanges formed at the free ends, said flanges extending at a right angle from the free ends outwardly with respect to each of the U-profiled shackles and being screwed to the main plate; and isolated longitudinal bars fixed by welding connection means at said corners and arranged away from said main plate, wherein said isolated longitudinal bars serve to transmit forces of pressure and said main plate serves to transmit tensile forces when said main plate is not covered with concrete or is covered with a unsolidified concrete layer, and wherein said isolated longitudinal bars serve to transmit tensile forces when said main plate is covered with a solidified concrete layer and said isolated longitudinal bars are embedded in an appropriate quantity of said solidified concrete layer.

2. The ceiling construction as claimed in claim 1, wherein said welding connection means between said isolated longitudinal bars and said U-profiled bars comprises at least one spot weld.

3. The ceiling construction as claimed in claim 1, wherein said web has a web width significantly larger than a shackle length of each of said U-profiled shackles.

4. The ceiling construction as claimed in claim 3, wherein said main plate is a cement plate.

5. The ceiling construction as claimed in claim 4, wherein said main plate is a wood cement plate.

6. A ceiling panel for a ceiling construction, said ceiling panel comprising:

a main plate having lateral abutment edges;

U-profiled shackles arranged in a row on said main plate and aligned with each other, each of said U-profile shackles having a web, two legs having free ends and extending from the web to the main plate and defining corners, and flanges formed at the free ends, said flanges extending at a right angle from the free ends outwardly with respect to each of the U-profiled shackles and being screwed to the main plate; and isolated longitudinal bars fixed by welding connection means at said corners and arranged away from said main plate.

* * * * *